US005098089A

United States Patent [19]

Harrington et al.

[11] Patent Number: 5,098,089

[45] Date of Patent: Mar. 24, 1992

[54] EXERCISE SIT-UP MACHINE AND METHOD

[75] Inventors: John J. Harrington, Los Angeles; Jay Stienbeck, Mission Hills, both of Calif.

[73] Assignee: Sit-Up Master, Inc., Mission Hills, Calif.

[21] Appl. No.: 524,334

[22] Filed: May 16, 1990

[51] Int. Cl.[5] ..... A63B 21/005

[52] U.S. Cl. ..... 482/140; 128/25 R; 5/610; 5/612; 482/145

[58] Field of Search ..... 272/96, 129, 134, 144, 272/145, 903; 128/25 R, 25 B, 70, 74; 5/60–62

[56] References Cited

U.S. PATENT DOCUMENTS

| | | | |
|---|---|---|---|
| D. 269,543 | 6/1983 | Walper et al. | D24/3 |
| 1,328,802 | 1/1920 | Anderson . | |
| 2,817,522 | 12/1957 | Margulies . | |
| 3,060,925 | 10/1962 | Honsaker et al. | 128/25 R |
| 3,307,534 | 3/1967 | Gibbs | 272/144 X |
| 3,712,613 | 1/1973 | Feather et al. . | |
| 4,194,500 | 3/1980 | Grimaldi | 272/144 |
| 4,408,183 | 10/1983 | Wills . | |
| 4,493,485 | 1/1985 | Jones | 272/126 |
| 4,502,679 | 3/1985 | De Lorenzo | 272/69 |
| 4,512,572 | 4/1985 | Hamm | 272/144 |
| 4,635,933 | 1/1987 | Schnell | 272/129 |
| 4,672,697 | 6/1987 | Schurch | 5/62 |
| 4,828,257 | 5/1989 | Dyer et al. | 373/129 |
| 4,884,803 | 12/1989 | Miller | 272/145 |
| 4,960,111 | 10/1990 | Steffensmeier | 128/70 X |

FOREIGN PATENT DOCUMENTS

| | | | |
|---|---|---|---|
| 3201334 | 7/1983 | Fed. Rep. of Germany | 128/25 R |

*Primary Examiner*—Richard J. Apley
*Assistant Examiner*—Joe H. Cheng
*Attorney, Agent, or Firm*—Spensley Horn Jubas & Lubitz

[57] ABSTRACT

A computer-controlled exercise sit up machine has a frame supporting a bed on which a user may rest his or her body, knee support posts for resting the user's knees, and foot rest support posts for receiving the user's feet and ankles. The exercise sit up machine has a triangular-shaped housing which acts as a fulcrum for pivoting the frame about a transverse axis so that the bed is inclined to a position where the user performs sit ups with the head at a higher vertical level than the feet. A computer controls a motor housed in the triangular-shaped housing for pivoting the frame about the fulcrum. The user may select a desired sit up routine. The computer then operates the machine through the chosen sit up routine and calculates and displays a sit up coefficient score to apprise the user of his or her performance.

9 Claims, 8 Drawing Sheets

EXERCISE SIT-UP MACHINE AND METHOD

BACKGROUND

1. Field of the Invention

The present invention relates to an exercise machine. In particular, the present invention relates to an exercise sit up machine which positions the user to emphasize the development and exercise of the user's abdominal muscles without emphasizing the development and exercise of the user's back and hip muscles.

2. Description of the Prior Art

Sit ups are traditionally done to exercise and develop a person's abdominal muscles. Sit ups may be done in a number of positions. Sit ups may be done on an inclined surface with the person's head at a position which is vertically lower than the position of his or her feet. However, sit ups done from this position tend to exercise and develop the person's back and hip muscles more than exercising and developing the abdominal muscles. This is because the back and hip muscles are predominantly used to overcome the force of gravity to raise his or her upper body from this position.

When sit ups are done by lying flat on a board or on the ground, the person's head is at the same vertical level as his or her feet. Sit ups may also be done on an inclined surface with the person's head at a position vertically above the feet. Sit ups done from these two positions do not require the person to use additional force to overcome the gravitational force in raising his or her upper body. More importantly, the back and hip muscles do not play such a major role in lifting the upper body. This allows the abdominal muscles to be properly exercised and developed.

Furthermore, therapy for patients suffering from back injuries often include the strengthening of the abdominal muscles because stronger abdominal muscles help the body to support the back and relieves the stress experienced by the back. Accordingly, sit ups done on an inclined surface with the patient's head at a position vertically above the feet are effective in helping such patients strengthen their abdominal muscles without straining their back muscles.

The exercise machines currently available generally allow the user to perform sit ups, if at all, either on a flat board or with the user's head at a position vertically below the feet. An example of such an exercise machine is described in U.S. Pat. No. 4,512,572 to Hamm, which may be vertically inclined for a user to perform sit ups in positions where the user's feet are at a higher vertical position than the user's head. Each of these machines has the disadvantage that they over-exercise and over-develop the user's back and hip muscles.

Many of these prior art exercise machines are programmable in that they are connected to a computer to electronically control the operation of the machines to facilitate different exercise routines. However, none of these prior art machines calculate and display a score for sit up routines performed by the user.

SUMMARY OF THE INVENTION

An exercise sit up machine according to this invention comprises a frame supporting a bed on which a user may rest his or her body, knee support posts for resting the user's knees, and foot rest support posts for receiving the user's feet and ankles. The exercise machine also has a triangular-shaped housing which acts as a fulcrum for pivoting the frame about an axis so that the bed is inclined to positions where the user performs sit ups with the head at a higher vertical position than the feet. Sit ups performed in such inclined positions allow the user to exercise and develop the user's abdominal muscles without over-exercising and over-developing the user's back and hip muscles.

The exercise sit up machine is also computer-controlled where the user may select a desired sit up routine. Each available sit up routine controls the pivoting of the frame through different inclined positions where the user may perform sit ups. The computer controls a motor housed in the triangular-shaped housing for pivoting the frame about the fulcrum to change the angle of inclination experienced by the frame. At the end of each sit up routine, the computer calculates a sit up coefficient score representative of the user's sit up performance and displays the sit up coefficient score.

The exercise sit up machine allows a user to perform sit ups in inclined positions which promote the development and exercise of the user's abdominal muscles without over-developing and over-exercising the back and hip muscles. The exercise sit up machine also allows patients suffering from back problems to strengthen their abdominal muscles by doing sit ups in positions where the strain on their backs is lessened.

BRIEF DESCRIPTION OF THE DRAWINGS

The invention will be described in connection with one embodiment thereof with reference to the accompanying drawings.

DESCRIPTION OF THE PREFERRED EMBODIMENT

Figure 1:
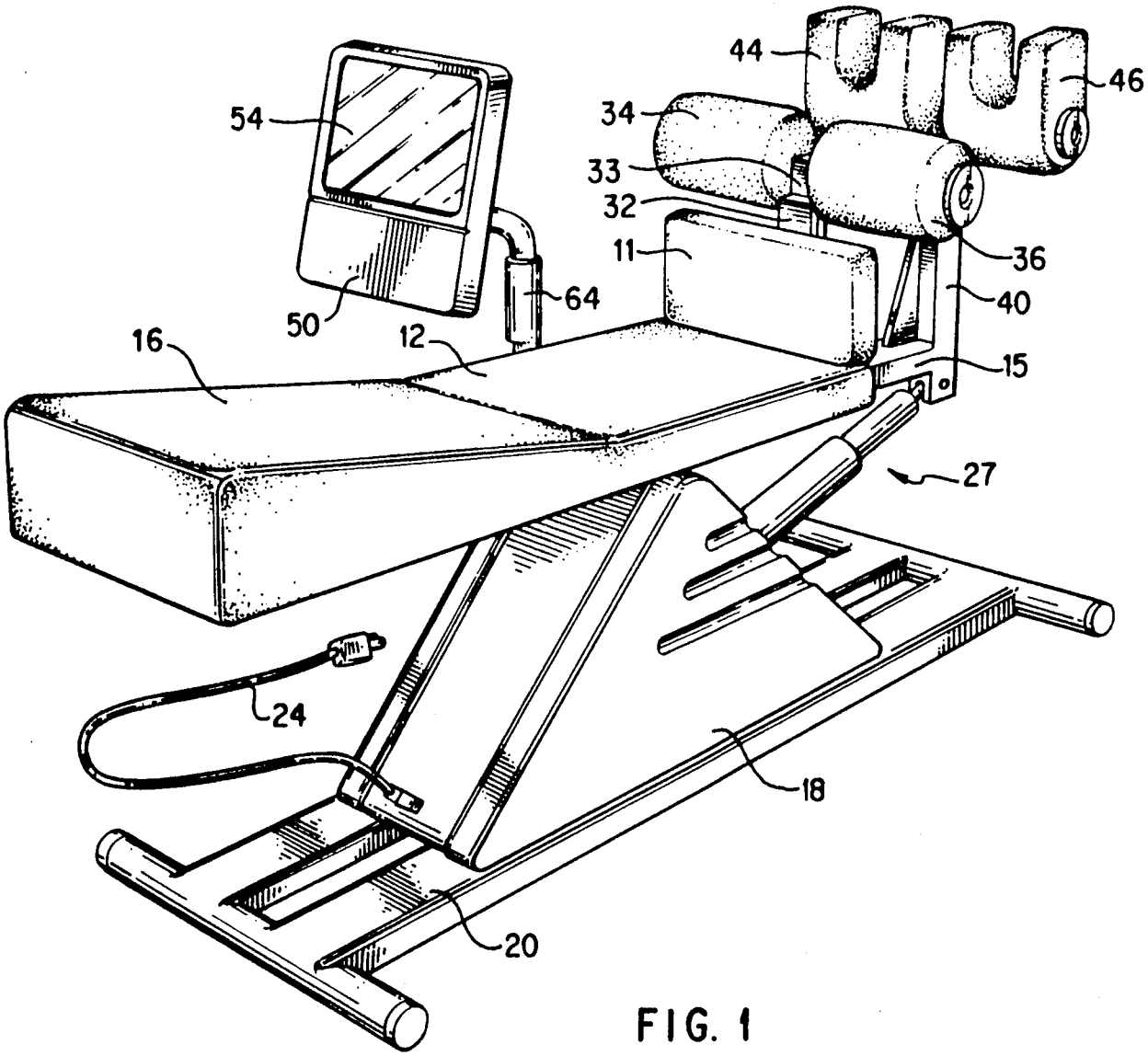
FIG. 1 is a perspective view of the sit up machine.
Figure 2:
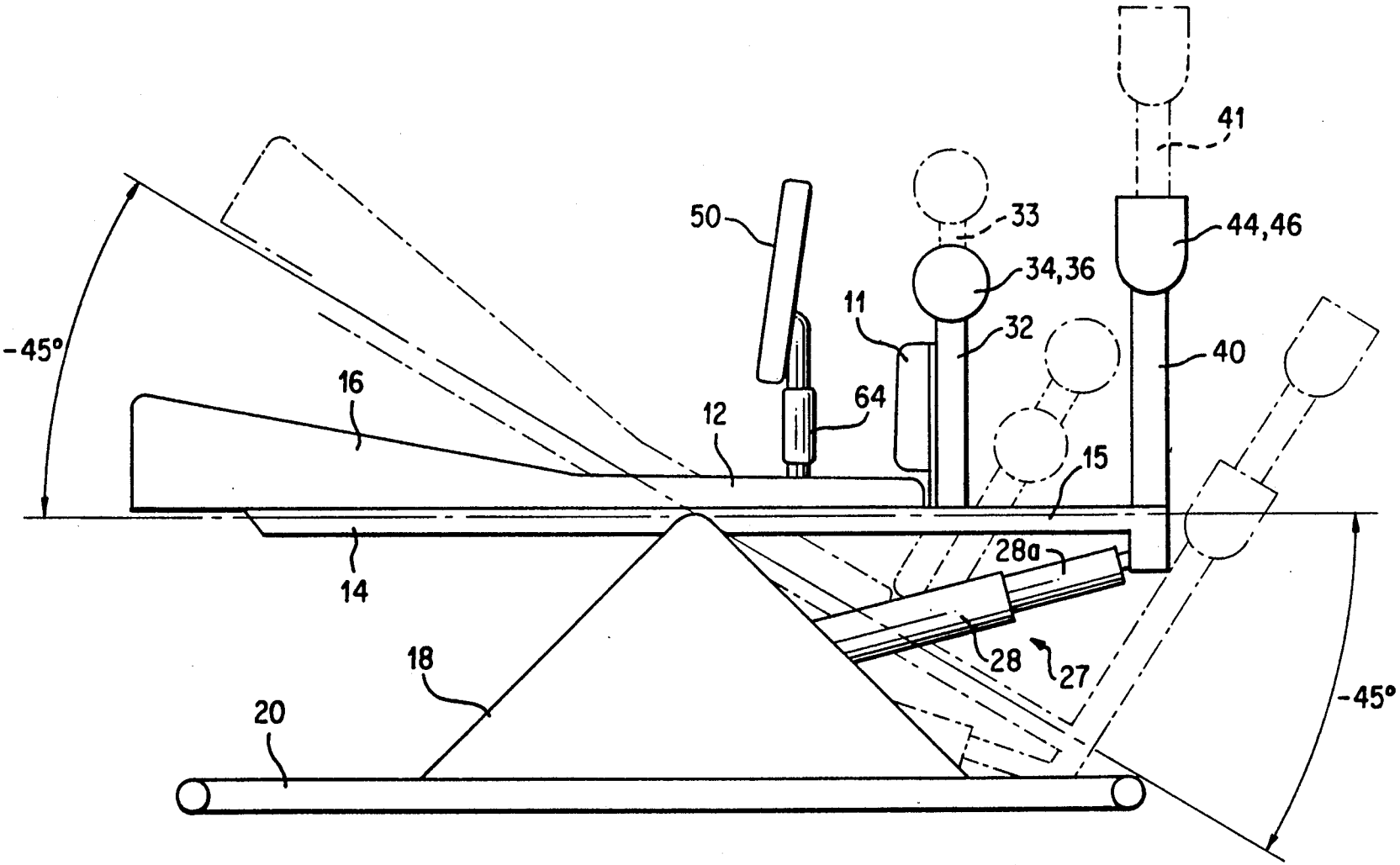
FIG. 2 is a side elevation view of the sit up machine of FIG. 1.

As shown in FIGS. 1 and 2, the sit up machine comprises a longitudinal base 20 having a triangular-shaped housing 18 mounted thereon. The housing 18 supports an elongated horizontal frame 14 extending longitudinally parallel to the base 20.

A bed 12 is secured to the frame 14 along the longitudinal center line of the bed 12. An end 15 of the frame 14 projects from the foot of the bed 12. The bed 12 has a contoured back cushion 16 for supporting a user's back and head. The bed 12 also has an end cushion 11 to prevent the user's body from sliding past the foot of the bed 12.

Figure 3:
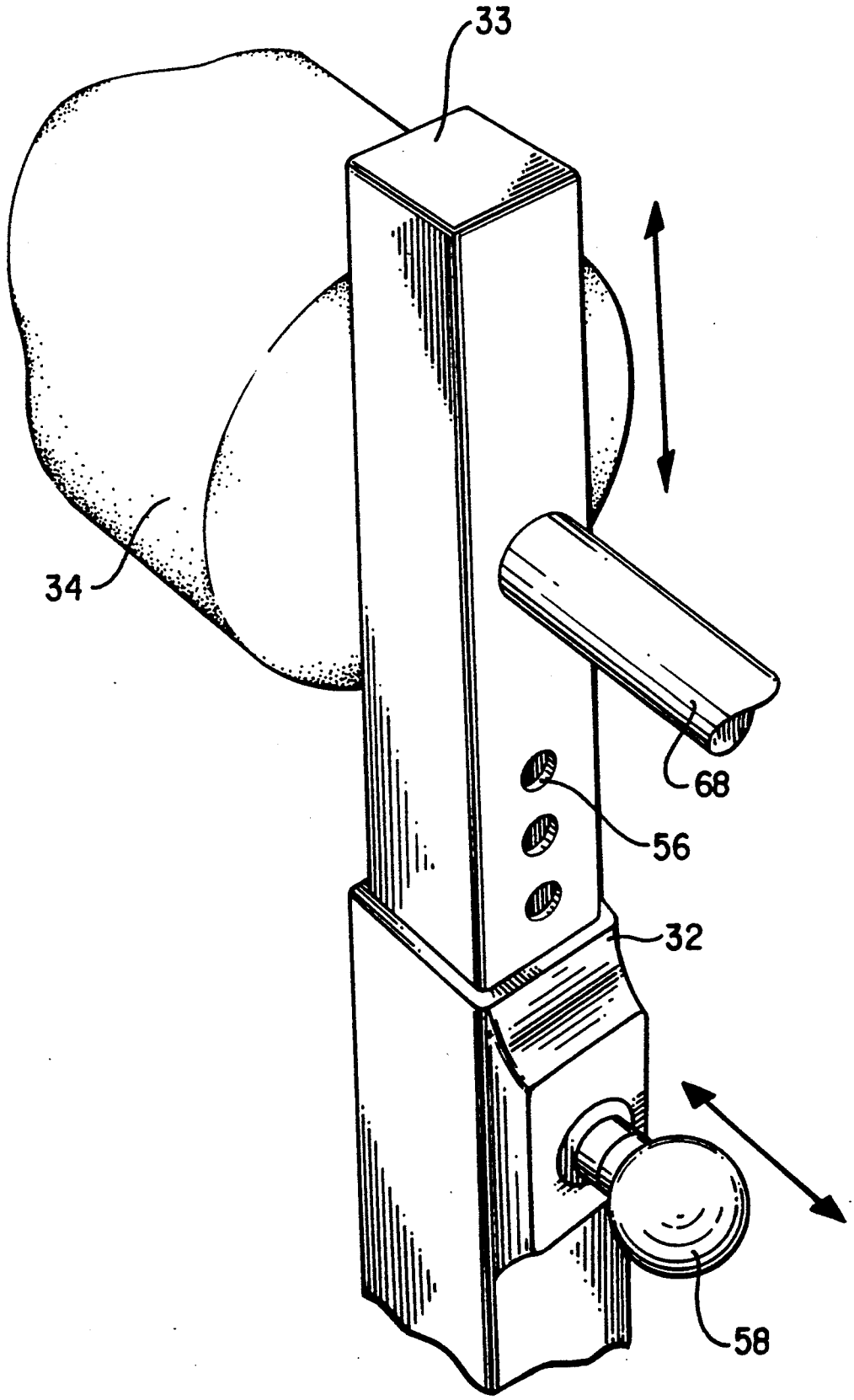
FIG. 3 is a perspective view of an adjustable knee rest mechanism forming part of the sit up machine of FIG. 1.

A vertical hollow knee rest support tube 32 is mounted on the end 15 of the frame 14 and, as shown in FIG. 3, receives an adjustable knee rest post 33. A horizontal shaft 68 extends transversely from the knee rest post 33 and supports a pair of cylindrically-shaped knee rest roller pads 34 and 36 at its opposite ends. The knee rest roller pads 34 and 36 provide support for resting the inner portions of the user's knees at a fixed position.

A vertical hollow foot rest support tube 40 is mounted at the extremity of the end 15 of the frame 14 and receives an adjustable foot rest stirrup post 41. As shown in FIG. 1, a pair of U-shaped foot rest stirrup pads 44 and 46 extend from the upper extremity of the stirrup post 41. The U-shaped opening in the stirrup pads 44 and 46 are of a size large enough to receive the user's ankle. The bottom of the stirrup pads 44 and 46 are rounded to allow a user to wrap his or her ankles around the rounded surface.

Thus, a user may bend his or her knees over the knee rest roller pads 34 and 36 and place his or her feet and ankles in one of two positions. In position 1, the ankles are placed into the U-shaped openings in the respective stirrup pads 44 and 46. In position 2, the ankles are placed under the stirrup pads 44 and 46.

Since some users have longer thighs than others, the height of the knee rest post 33 may be adjusted to accommodate users of different heights. For example, a user with longer thighs may lengthen the height of the knee rest post 33 while a user with shorter thighs may shorten the height of the knee rest post 33. Furthermore, the foot rest stirrup post 41 may be adjusted to a height where the user may comfortably position his or her ankles either in the U-shaped openings of the stirrup pads 44 and 46 or under the stirrup pads 44 and 46 without having to bend the knees at a severe angle.

The height of the knee rest post 33 may be manually adjusted as follows. As shown in FIG. 3, a plurality of pairs of holes 56 are journaled through the knee rest post 33. The hollow knee rest support tube 32 has one pair of corresponding holes on its opposite sides. A height adjustment knob 58 may be fitted through the corresponding holes of the support tube 32 and the knee rest post 33 to lock the knee rest post 33 at a predetermined height. For example, the height of the knee rest post 33 may be lowered by removing the knob 58, lowering the knee rest post 33 so that next hole 56 in the knee rest post 33 corresponds to the pair of holes in the support tube 32, and re-inserting the knob 58 through the newly-chosen set of holes. The height of the foot rest stirrup post 41 may also be adjusted in a similar way.

Figure 7:
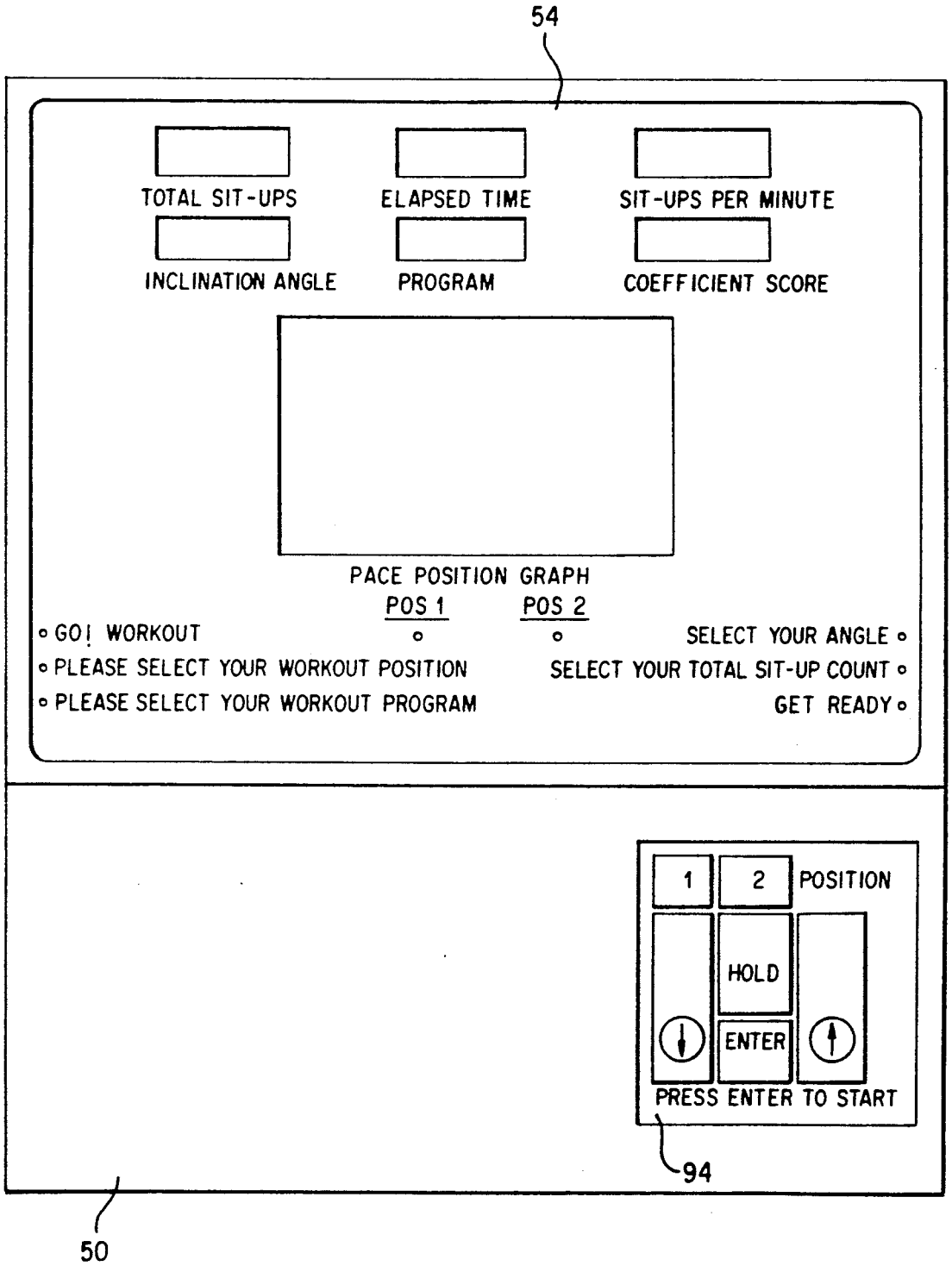
FIG. 7 is a front elevation view of a display forming part of the sit up machine of FIG. 1.

A display housing 50 is supported by an arm 64 which extends from the housing 18. As shown in FIG. 7, the display housing 50 has a display 54 and a keypad 94 for the user to control the operation of the sit up machine. The display 54 displays information about the user's current sit up routine, such as the angle of inclination of the bed 12, the elapsed time, the user's sit up coefficient score, the workout position, and the selected program, among others. The use of the display 54 and the keypad 94 shall be further explained later in connection with the operation of the sit up machine.

Figure 4:
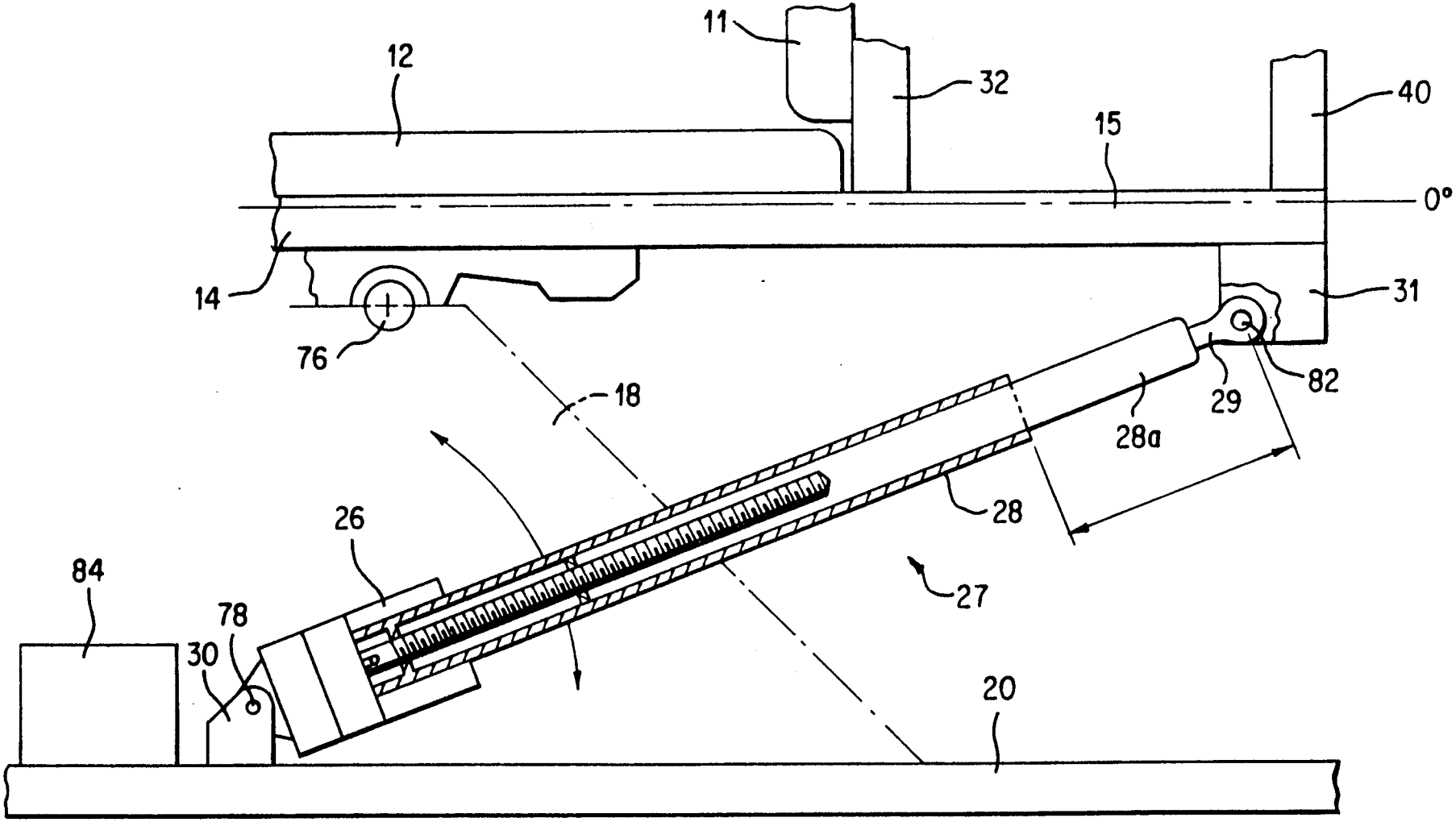
FIG. 4 is a side elevation view of a drive tube mechanism comprising part of the sit up machine of FIG. 1.

Referring to FIGS. 1, 2 and 4, the triangular-shaped housing 18 pivots the frame 14 near its central portion and acts as a fulcrum to facilitate the simultaneous raising and lowering of the 10 opposite ends of the frame 14, or pivoting, about a transverse axis 76. A computer 84 is housed in the housing 18. A motor 26 is mounted on the base 20 via a motor mount 30 and also housed within the housing 18. The motor 26 receives power from a power supply 24.

Figure 5:
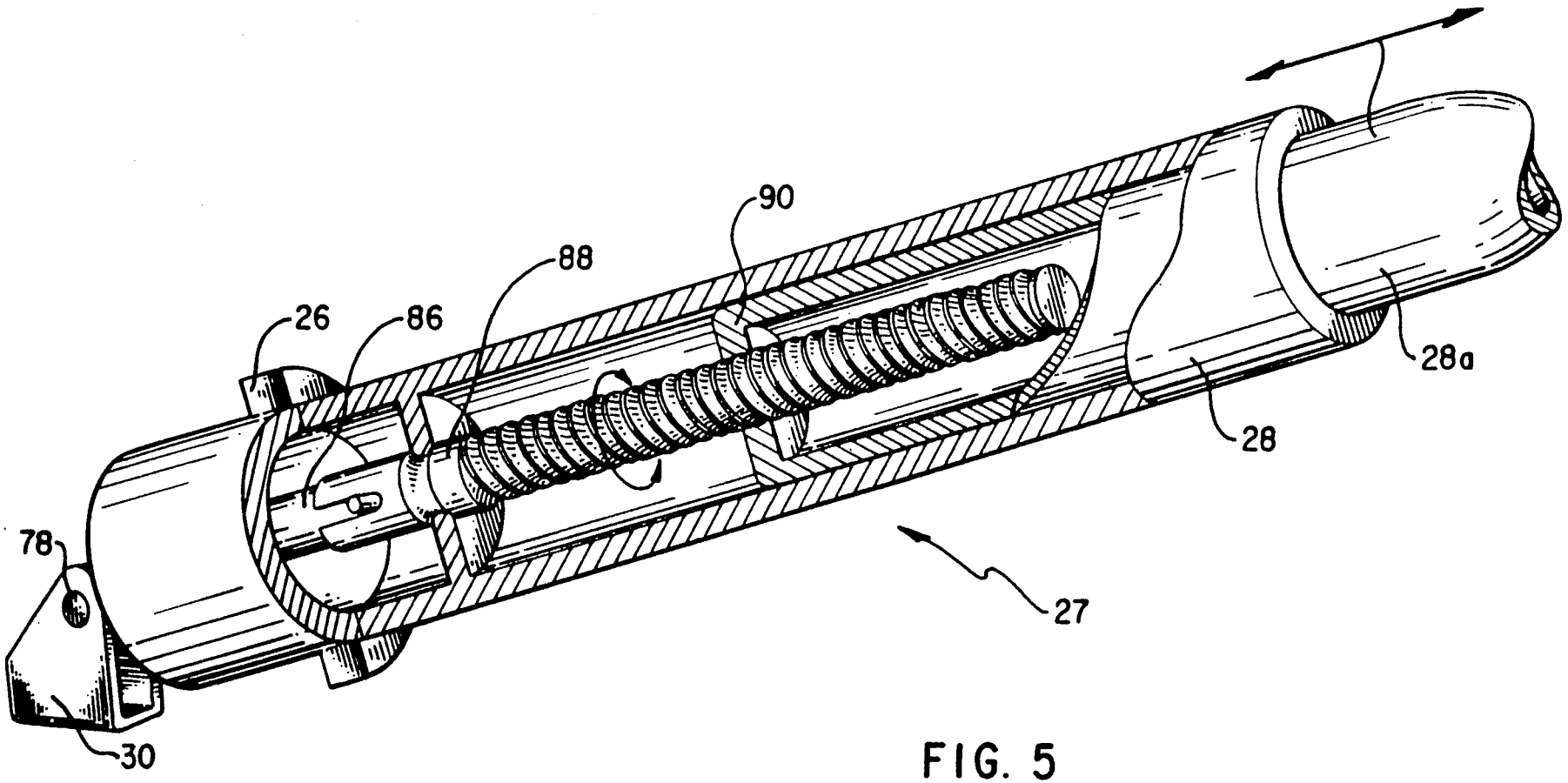
FIG. 5 is a perspective view of the drive tube mechanism of FIG. 4.

As shown in FIGS. 4 and 5, a drive assembly 27 connects the frame 14 to the motor 26. The assembly 27 includes a drive tube 28 coupled to the motor 26 at one end and extending radially outwardly from the housing 18. The other end of the drive tube 28 receives a telescopic tube **28*a*. One end of the telescopic tube 28*a* is coupled via a link 29 to an attachment 31 mounted on the underside of the frame 14 at the outer extremity of the frame end 15. The other end of the telescopic tube 28*a* has a threaded opening 90 which receives a lead screw 88 disposed within the drive tube 28. The lead screw 88 is in turn coupled to a drive shaft 86**.

In operation, the computer 84 provides control signals to the motor 26 to rotate the drive shaft 86. This causes the lead screw 88 to rotate in one of two directions. When the lead screw 88 is rotated in one direction, it retracts or pulls the telescopic tube **28*a* into the drive tube 28. At the same time, the motor 26 pivots its position about a transverse axis 78 to accommodate the retraction of the telescopic tube 28*a*. This pivots the attachment 31 and the link 29 about a transverse axis 82 to lower the end 15 of the frame 14. The lowering of the end 15 of the frame 14 pivots the frame 14 about the axis 76 defined by the fulcrum of the housing 18 to simultaneously raise the opposite end of the frame 14 by an equivalent amount. For example, when the end 15 of the frame 14 is lowered by one degree, the opposite end of the frame 14 is simultaneously raised by one degree. As a result, the frame 14 and the bed 12 are pivoted through a variety of inclination angles within specified limits, as shown in FIG. 2**.

When the lead screw 88 is rotated in the other direction, it drives the telescopic tube **28*a* out of the drive tube 28. This causes the simultaneously raising of the end 15 of the frame 14 and lowering of the opposite end of the frame 14**.

Figure 6:
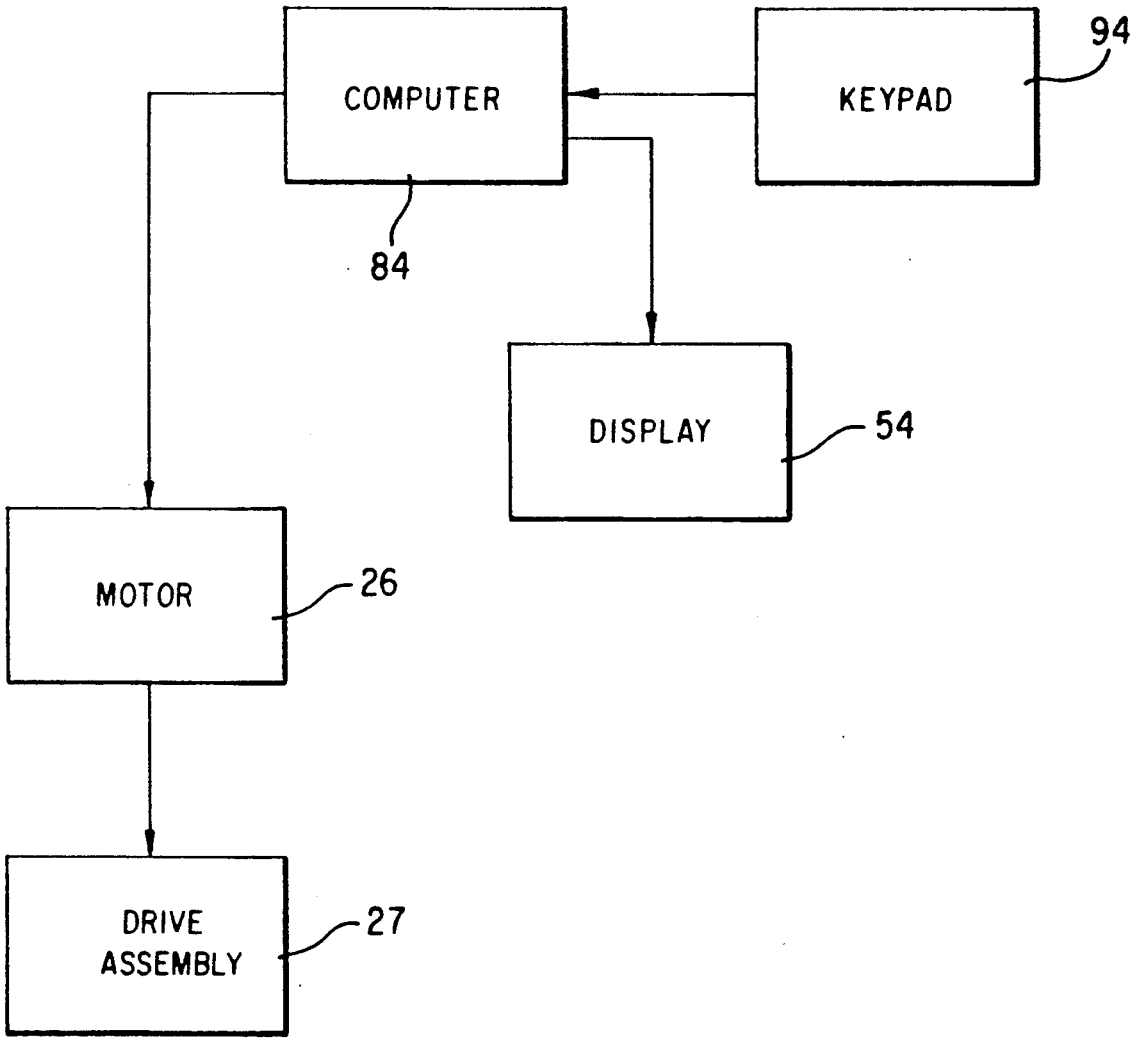
FIG. 6 is a block diagram illustrating the electrical interconnections of the sit up machine of FIG. 1.

Referring to FIG. 6, the computer 84 receives command signals from the keypad 94 indicative of the selected program, exercise time, workout position, selected angle of inclination and number of sit ups performed. The computer 84 processes these command signals and transmits control signals to the motor 26 which controls the drive tube 28 to pivot the frame 14. The computer 84 also transmits information signals to the display 54 representing information such as the selected program, the angle of inclination of the bed 12, the elapsed time, the user's sit up coefficient score, and the workout position, among others.

Sit ups may be done in a number of positions. Sit ups may be done on an inclined surface with the person's head at a position vertically below his or her feet. Sit ups done from this position tend to exercise and develop the person's back and hip muscles more than exercising and developing the abdominal muscles. This is because the back and hip muscles are predominantly used to overcome the force of gravity to raise his or her upper body from this position.

Sit ups may also be done by lying flat on a board or on the ground with the person's head at the same level as his or her feet. Sit ups may also be done on an inclined surface with the person's head at a higher vertical position than the feet. Sit ups done from these two positions do not require the person to use additional force to overcome the gravitational force in raising his or her upper body; and in fact, gravity assists the person in lifting up the upper body. More importantly, the back and hip muscles do not play such a major role in lifting the upper body. This allows the abdominal muscles to be properly exercised and developed.

Accordingly, the sit up machine of the present invention allows sit ups to be performed either with the user's head at a position level with the feet, that is, at an inclination angle of 0°, or with the user's head at a position above the feet, that is, at a negative inclination angle. The sit up machine may be operated to pivot the bed 12 between inclination angles of 0° and, for example, −45°, as shown in FIG. 2. It will be understood by one skilled in the art that the bed 12 may be pivoted between 0° and any desired negative inclination angle. In operation, the bed 12 may start at the flat or 0° position and be gradually pivoted one degree at a time until it reaches the −45° position shown in phantom in FIG. 2. The bed 12 may then be pivoted in the opposite direction one degree at a time until it returns to the 0° position.

Pivoting the bed 12 allows the user to perform sit ups at varying inclination angles. This aspect of the invention is important since sit ups done at varying inclination angles allows the user to go through a sit up program where the difficulty of the sit ups varies. For instance, the most difficult sit ups are those performed with the bed 12 at the flat or 0° position. Conversely, the easiest sit ups are performed with the bed 12 at the −45° position, where the user's head is furthest above the feet.

To perform sit ups, the user lies on the bed 12 and rests his or her back on the back cushion 16. The user then adjusts the height of the knee rest post 33 and places his or her knees over the knee rest roller pads 34 and 36. After adjusting the height of the foot rest stirrup post 41, if necessary, the user places his or her ankles in one of two positions. The user may secure the ankles within the U-shaped openings of the stirrup pads 44 and 46 ("position 1"). The user may also place the ankles under the stirrup pads 44 and 46 ("position 2").

Figure 8:
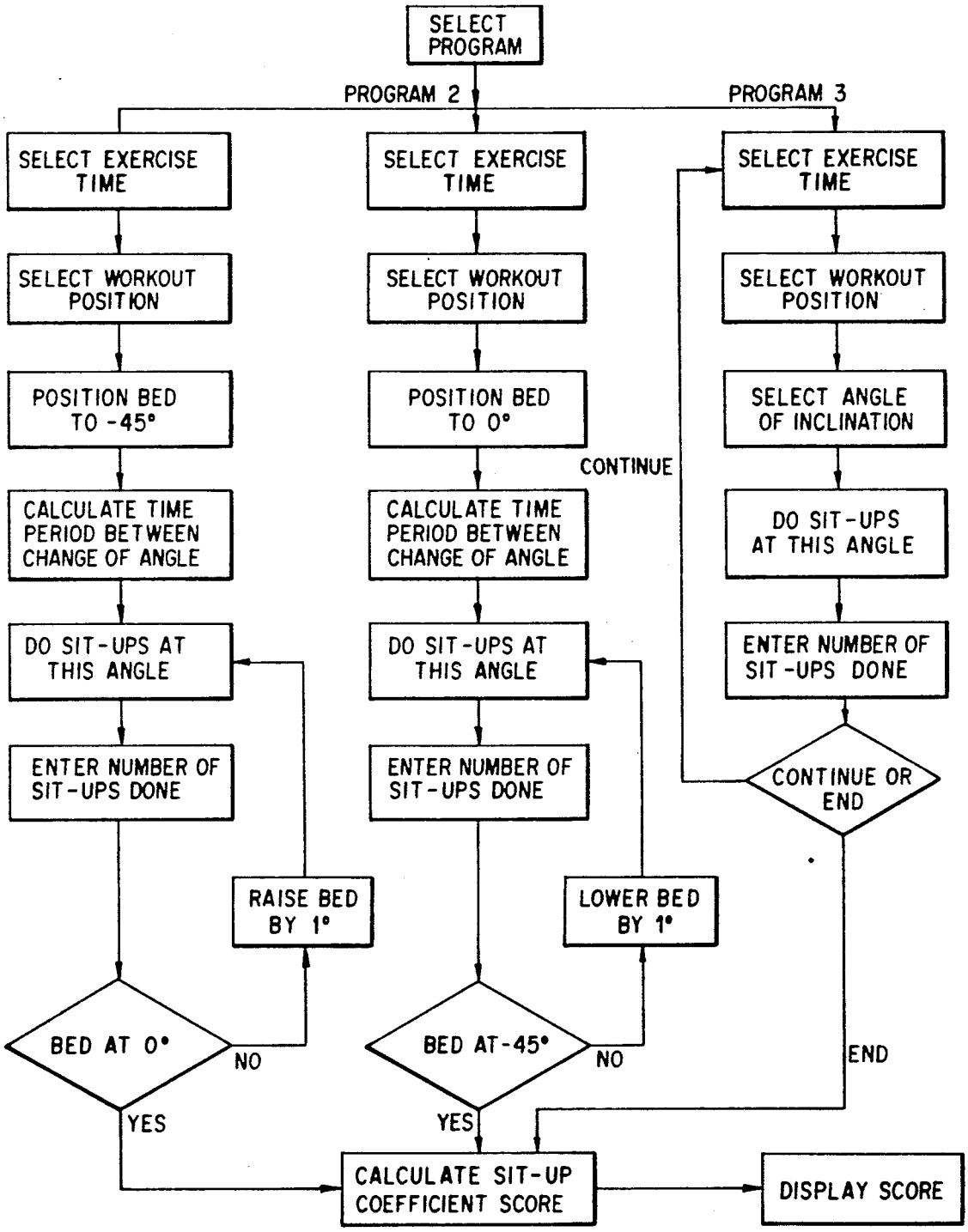
FIG. 8 is a flow diagram illustrating the operation of the sit up machine of FIG. 1.

The operation of the sit-up machine is now described with reference to the display of FIG. 7 and the flow diagram of FIG. 8. The user first selects the desired sit up program. Three programs are available to the user. To select any of the three programs, the user first presses "ENTER" to start. The user then selects the program number by using the up and down keys and then pressing "ENTER" a second time. The user also uses the up and down keys to select the desired exercise time (in minutes), and then presses "ENTER" a third time. Finally, the user specifies the workout position by pressing either 1 or 2. In workout position 1, the user places the ankles in the U-shaped opening of the stirrup pads 44 and 46, while in workout position 2, the user places the ankles under the stirrup pads 44 and 46.

Automatic Program 1 is known as the "Easy To Difficult" program. This program allows the user to begin the sit up routine at the "easiest" or −45° position which is at an inclination angle of −45°. The user performs sit ups with the bed 12 inclined at this angle for a predetermined period of time; for example, one minute. The time period between each change of angle is determined by the computer according to the exercise time selected by the user. For instance, if the user has selected an exercise time of 45 minutes, then the time period would be one minute (45 minutes divided by 45 angles is equal to one minute per angle). After doing sit ups at the −45° position for one minute, the user enters the total number of sit ups performed at this angle during the one-minute period. Thereafter, the computer 84 controls the motor 26 to pivot the bed 12 by one degree to the −44° position, where the user performs sit ups for another minute. This process repeats itself so that the user performs sit ups for one minute at each inclination angle between −45° and 0°. When the bed 12 to pivoted to the level or 0° position and the user completes one minute of sit ups at that position, the program terminates. The user's sit up coefficient score is then calculated by the computer 84 and displayed.

The sit up coefficient score is calculated on a point system by using a formula. Two different coefficient formulae are used, depending on the workout position chosen by the user. If workout position 1, where the ankles are placed in the stirrup pads 44 and 46, is chosen, the coefficient formula is:

$$\text{Coefficient} = \Sigma((\text{number of sit ups}) * (\text{angle}) * 0.01)$$

where "angle" is equal to the absolute value of:

$$\text{"angle"} = \text{inclination angle} - (-45°)$$

For example, if the user performs ten sit ups at each inclination angle, the coefficient score would be calculated as follows:

| Inclination Angle | (number of sit ups) | * | (angle) | *0.01 | Coefficient |
|---|---|---|---|---|---|
| −45 | 10 | * | 0 | *0.01 | 0 |
| −44 | 10 | * | 1 | *0.01 | 0.1 |
| −43 | 10 | * | 2 | *0.01 | 0.2 |
| — | — | — | — | — | — |
| 0 | 10 | * | 45 | *0.01 | 4.5 |
| | | Sit Up Coefficient Score: | | | 103.5 |

In workout position 2, where the ankles are placed under the stirrup pads 44 and 46, is chosen, the coefficient formula is very similar to that for position 1 and is as follows:

$$\text{Coefficient} = \Sigma((\text{number of sit ups}) * (\text{angle}) * 0.03)$$

Sit ups performed in position 2 are generally acknowledged to be more difficult than sit ups performed in position 1, and the two coefficient formulae account for the varying difficulties in determining the user's sit up coefficient score.

Automatic Program 2 is known as the "Difficult To Easy" program. It is essentially the same as Program 1 except that the user begins the sit up routine at the 0° or most "difficult" position, and finishes the routine at the −45° or "easiest" position.

Manual Program 3 allows the user to manually select the angles or positions at which the sit ups are being performed. The user may perform sit ups at any position for any duration of time and then change the position and exercise duration for doing additional sit ups. However, the sit up machine will only position the bed 12 at inclination angles between the limits of 0° and −45°. If the sit up machine receives a selected angle outside these limits, the sit up machine will position the bed 12 at the nearest limit angles. The user may also select different workout positions. Furthermore, the user enters the total number of sit ups performed at a particular position before selecting a new position and exercise duration. The user's sit up coefficient score is calculated by the computer 84 and displayed at the end of the exercise routine.

While the invention has been shown and described with reference to a preferred embodiment thereof, it will be appreciated by those having skill in the art that variations in form and detail may be made therein without departing from the spirit and scope of the invention.

What is claimed is:

1. An apparatus for use in performing sit-ups, said apparatus comprising:

a bed having upper support means on one end of the bed for allowing a user to rest the user's upper body;

a frame for holding said bed;

leg support means coupled to one end of said frame and continuous to the opposite end of said upper support means of said bed for holding the user's legs in a fixed position;

means for supporting said frame about a transverse axis;

a motor housed in said supporting means;

means for connecting said one end of said frame with said motor; and control means having a computer means for pivoting said frame about said transverse axis to locate said frame at a plurality of positions, for holding said frame stationary at each of said plurality of positions for a predetermined period of time before being pivoted to the next position and for processing information relating to said sit-ups performed by said user, and a display coupled to said computer means for displaying said information, wherein said plurality of positions ranging from a position in which said frame is substantially horizontal to a position in which said frame is inclined at an angle with said horizontal position such that said user performs sit-ups with the user's head at a higher vertical level than the user's feet in each of said plurality of positions.

2. The apparatus of claim 1, wherein said plurality of positions range from a position in which said frame is substantially horizontal to a position in which said frame is inclined at an angle of −45° with said horizontal position.

3. The apparatus of claim 2, wherein said control means initially holds said frame at said horizontal position and progressively pivots said frame through said plurality of positions until said frame is located at said −45° position.

4. The apparatus of claim 2, wherein said control means initially holds said frame at said −45° position and progressively pivots said frame through said plurality of positions until said frame is located at said horizontal position.

5. The apparatus of claim 1, wherein said leg support means comprises knee rest means for allowing said user to rest the user's knees and foot rest means for supporting the user's feet.

6. The apparatus of claim 5, wherein said knee rest means comprises means for adjusting the height of said knee rest means; and wherein said foot rest means comprises means for adjusting the height of said foot rest means.

7. The apparatus of claim 1, wherein said plurality of positions includes at least four positions.

8. A method for performing a sit-up exercise routine on an exercise sit-up machine, the machine including a bed having a first end with a head rest means where a user normally rests the user's head, a frame holding said bed having leg support means coupled to a second end of said bed opposite to the first end of said bed, a motor housed in a housing means, means for connecting said frame with said motor, and control means having computer means for pivoting and holding said frame about a transverse axis to a plurality of positions for a predetermined period of time and display means for displaying information relating to the sit-up routine performed by said user, said method comprising the steps of:

(a) setting the bed to a horizontal position;

(b) maintaining the bed at the horizontal position for a predetermined period of time;

(c) simultaneously raising the first end of the bed by a predetermined amount and lowering the second end of the bed by a predetermined degree of angle to reach a new position of the plurality of positions;

(d) maintaining the bed at the new position for said predetermined period of time;

(e) displaying information relating to the sit-up routine performed by the user; and (f) repeating steps (c), (d) and (e) for a predetermined number of times.

9. A method for performing a sit-up exercise routine on an exercise sit-up machine, the machine including a bed having a first end with a head rest means where a user normally rests the user's head, a frame holding said bed having leg support means coupled to a second end of said bed opposite to the first end of said bed, a motor housed in a housing means, means for connecting said frame with said motor, and control means having computer means for pivoting and holding said frame about a transverse axis to a plurality of positions for a predetermined period of time and display means for displaying information relating to the sit-up routine performed by said user, said method comprising the steps of:

(a) setting the bed to an initial inclined position where the first end of the bed is at a higher vertical level than the second end of the bed;

(b) maintaining the bed at the initial inclined position for a predetermined period of time;

(c) simultaneously lowering the first end of the bed and raising the second end of the bed by a predetermined degree of angle to reach a new position of the plurality of positions;

(d) maintaining the bed at the new position for said predetermined period of time;

(e) displaying information relating to the sit-up routine performed by the user; and (f) repeating steps (c), (d) and (e) for a predetermined number of times.

* * * * *